US005971171A

United States Patent [19]

Thorp et al.

[11] Patent Number: 5,971,171

[45] Date of Patent: Oct. 26, 1999

[54] DOCUMENT STORAGE AND DISPLAY UNIT

[75] Inventors: Clarkson S. Thorp, Wayland; Douglas R. Himebaugh, Fruitport, both of Mich.

[73] Assignee: Haworth, Inc., Holland, Mich.

[21] Appl. No.: 09/089,533

[22] Filed: Jun. 3, 1998

[51] Int. Cl.[6] ..... A47F 5/00

[52] U.S. Cl. ..... 211/128.1; 211/55; 248/441.1; 108/92

[58] Field of Search ..... 211/128.1, 55, 211/45; 108/92; 248/441.1

[56] References Cited

U.S. PATENT DOCUMENTS

| | | |
|---|---|---|
| D. 118,484 | 1/1940 | Salomon . |
| D. 250,960 | 1/1979 | Bitner, Jr. et al. . |
| D. 301,490 | 6/1989 | Horowitz . |
| D. 367,501 | 2/1996 | Molt . |
| D. 370,571 | 6/1996 | Newhouse et al. . |
| D. 388,465 | 12/1997 | Markelz et al. . |
| D. 389,336 | 1/1998 | Moore . |
| D. 389,667 | 1/1998 | Moore . |
| D. 389,870 | 1/1998 | Hart et al. . |
| 581,237 | 4/1897 | Mautz . |
| 808,318 | 12/1905 | Thomas et al. . |
| 1,898,666 | 2/1933 | Isaacson . |
| 2,153,422 | 4/1939 | Kroman . |
| 2,305,244 | 12/1942 | Erickson . |
| 2,480,233 | 8/1949 | Fuller . |
| 2,520,490 | 8/1950 | Boward . |
| 2,607,052 | 8/1952 | Le Roy . |
| 3,160,283 | 12/1964 | Lachance . |
| 3,366,415 | 1/1968 | Cooper . |
| 3,464,372 | 9/1969 | Fiterman et al. . |
| 3,759,569 | 9/1973 | Bennet . |
| 3,895,720 | 7/1975 | Presberg . |
| 4,569,498 | 2/1986 | Ermanski . |
| 4,605,988 | 8/1986 | Nienhuis et al. . |
| 4,612,863 | 9/1986 | Vonhausen et al. . |
| 4,796,847 | 1/1989 | Kayner ..... 248/441.1 |
| 4,802,595 | 2/1989 | Northington . |

(List continued on next page.)

FOREIGN PATENT DOCUMENTS

| | | |
|---|---|---|
| 0 481 159 A1 | 4/1992 | European Pat. Off. . |
| 0 531 794 A1 | 3/1993 | European Pat. Off. . |
| 1 221 737 | 6/1960 | France . |
| 92 04 035 | 6/1992 | Germany . |
| 4-5910 | 1/1992 | Japan . |
| 2 204 479 | 11/1988 | United Kingdom . |

OTHER PUBLICATIONS

Levenger Holiday 1994 Brochure, p. 40, received in the PTO Sept. 30, 1994.

Drawings from U.S. Provisional Application Serial No. 60/019 407, filed June. 7. 1996, RIM TOP TABLE (Atty Ref: Haworth PA C–01).

Drawings from U.S. Provisional Application Serial No. 60/019 425, filed June. 7, 1996, Special Organizer for Papers (Atty Ref: Haworth PA C–03).

Drawings from U.S. Provisional Application Serial No. 08/870 954, filed June 6, 1997, Table With Article–Supportive Surround (Atty Ref: Haworth Case 240).

Drawings from U.S. Application Serial No. 08/870 789, filed June 6, 1997, Computer Work Station (Atty Ref: Haworth C–242).

Drawing Fig. 1 and 7 from U.S. Application Serial No. 08/890 914 filed July 10, 1997, Work Station (Atty Ref: Haworth Case 249).

*Primary Examiner*—Robert W. Gibson, Jr.
*Attorney, Agent, or Firm*—Flynn, Thiel, Boutell & Tanis, P.C.

[57] ABSTRACT

A document storage and display unit including two vertically adjacent but horizontally offset shelves for the storage and display of documents or other articles. An upper portion of each of the shelves is defined by a screen panel and a lower portion of the shelves is defined by a trough-like tray which is usable for storing work-related items. The storage and display unit is adapted so as to be mountable to a work surface such as a table or is usable as a freestanding unit along with an upright stand, and is rotatable to any desired position with respect to the work surface or stand.

19 Claims, 7 Drawing Sheets

U.S. PATENT DOCUMENTS

| | | | |
|---|---|---|---|
| 4,852,500 | 8/1989 | Ryburg et al. . | |
| 4,914,873 | 4/1990 | Newhouse . | |
| 4,938,366 | 7/1990 | Carroll . | |
| 4,948,205 | 8/1990 | Kelley . | |
| 5,009,335 | 4/1991 | Jonker . | |
| 5,024,167 | 6/1991 | Hayward . | |
| 5,120,117 | 6/1992 | Williams . | |
| 5,289,926 | 3/1994 | Lewis et al. . | |
| 5,301,068 | 4/1994 | Minisci . | |
| 5,357,873 | 10/1994 | Hilton . | |
| 5,473,994 | 12/1995 | Foley et al. . | |
| 5,609,112 | 3/1997 | Meyer et al. . | |
| 5,694,862 | 12/1997 | Grubb . | |
| 5,758,781 | 6/1998 | Lord et al. . | |
| 5,823,359 | 10/1998 | Harris et al. . | |
| 5,908,002 | 6/1999 | Alexander et al. | 108/92 X |

DOCUMENT STORAGE AND DISPLAY UNIT

FIELD OF THE INVENTION

The invention relates to an article or document storage and display unit for use in an office-type environment and, more particularly, to a document storage and display unit which is adapted for use with a work surface such as a table or as a freestanding unit.

BACKGROUND OF THE INVENTION

Most offices or work environments include conventional work surfaces such as tables and desks for supporting papers and the like as they are being used. However, for jobs or projects which have a large volume of papers, conventional work surfaces typically provide limited table or desk top space. This limited space can make it difficult to manage a large amount of papers or documents as they are being used. More specifically, the worker typically has a limited amount of space in which to spread out and display the documents which can make it more difficult to sort and organize the documents.

A known work station arrangement developed by the Assignee of the present invention which is the subject of U.S. patent application Ser. No. 08/870 954 includes a table with a horizontally enlarged work surface and an article supportive surround which extends upwardly from the rear edge of the table and is fixedly attached thereto. Thus, the article supportive surround is not adapted for mobility or for uses other than with a table.

SUMMARY OF THE INVENTION

It is an object of the invention to provide a document storage and display unit which facilitates the display and organization of documents or other articles being used by a worker, and which is usable with a conventional work surface such as a table or desk or as a freestanding unit which can be moved to any desired work area.

More particularly, the document storage and display unit, when used with a work surface such as a table, extends generally sidewardly along a rear edge of the table and extends upwardly therefrom. The storage and display unit defines a plurality and preferably two shelves which are vertically joined together but are horizontally offset. Each shelf includes a bottom wall portion which extends generally rearwardly and a rear wall portion which extends upwardly at an angle so as to store documents in an upwardly inclined position.

The storage and display unit is preferably formed of a rigid open frame having a mounting arrangement which is connectable to a work surface or usable with an upright stand. The mounting arrangement is such that the unit is pivotable with respect to the work surface or stand.

A screen of perforated metal covers the frame and defines the upright rear wall portions of the shelves. The screen is light in weight and facilitates the flow of air and light therethrough. Further, an elongate tray defines the bottom wall portions of the shelves and is usable for storage of work-related objects, such as writing instruments.

Other objects and purposes of the invention, and variations thereof, will be apparent upon reading the following specification and inspecting the accompanying drawings.

Figure 1:
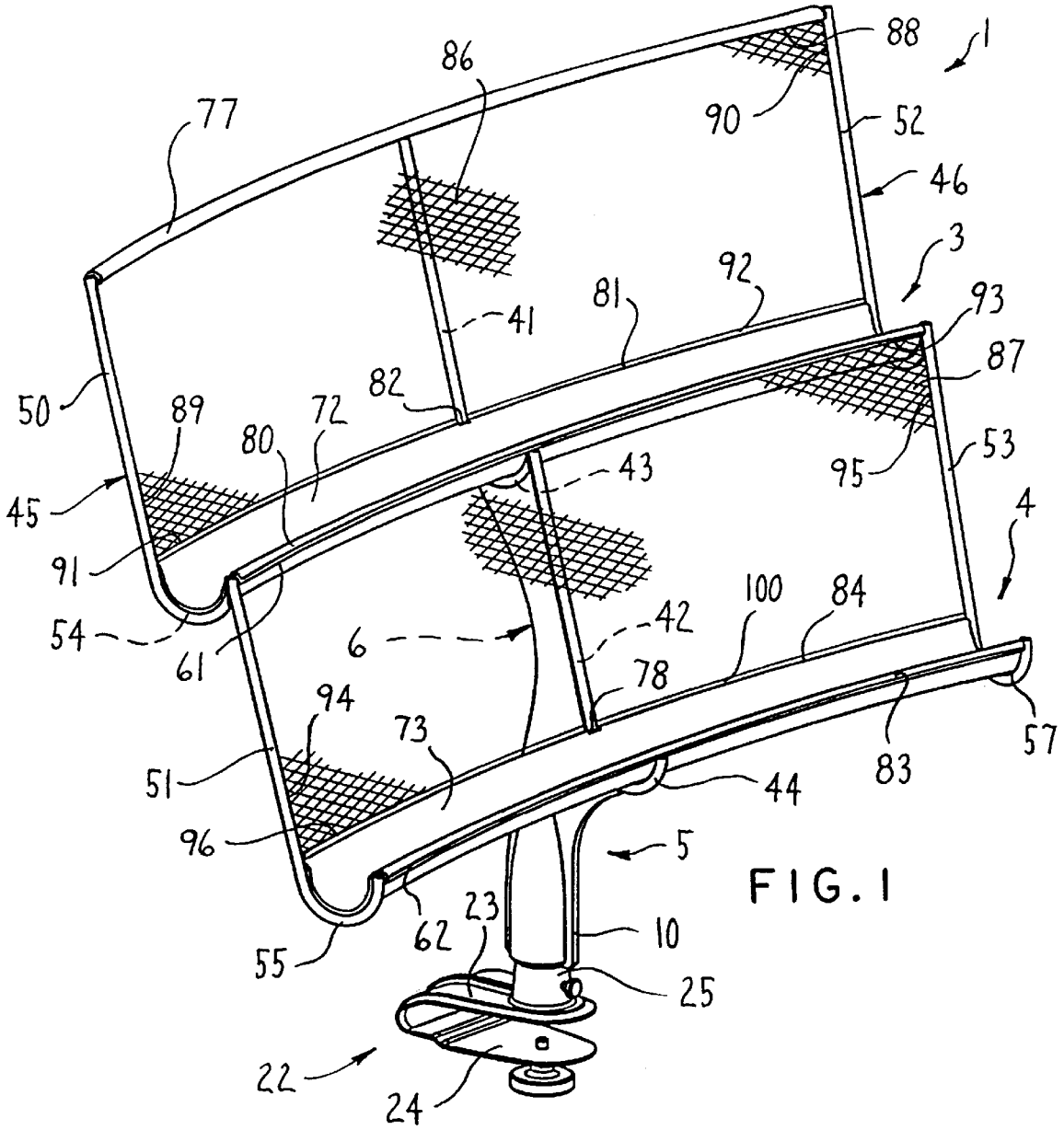
FIG. 1 is a perspective view of the document storage and display unit according to the invention.
Figure 3:
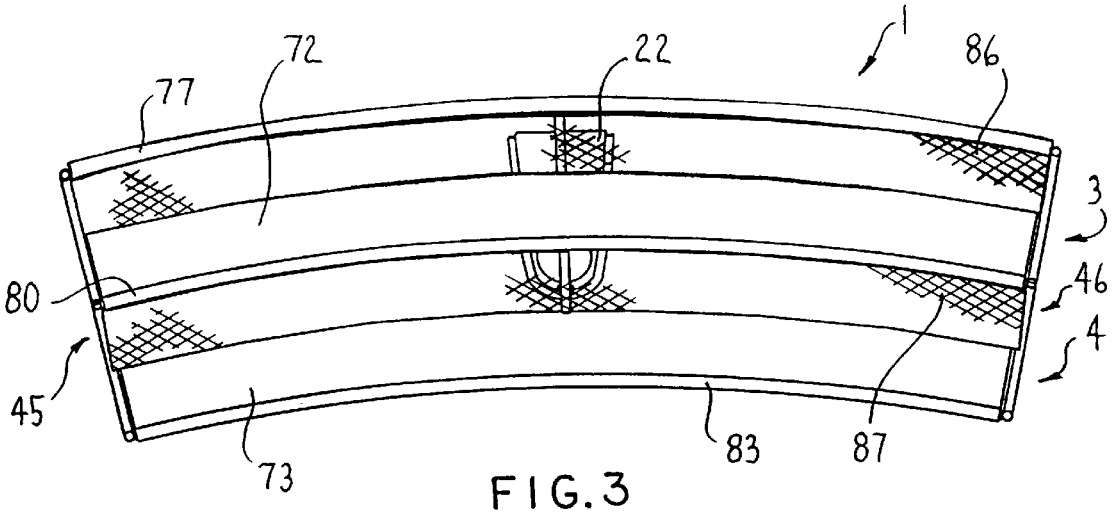
FIG. 3 is a top view thereof.
Figure 2:
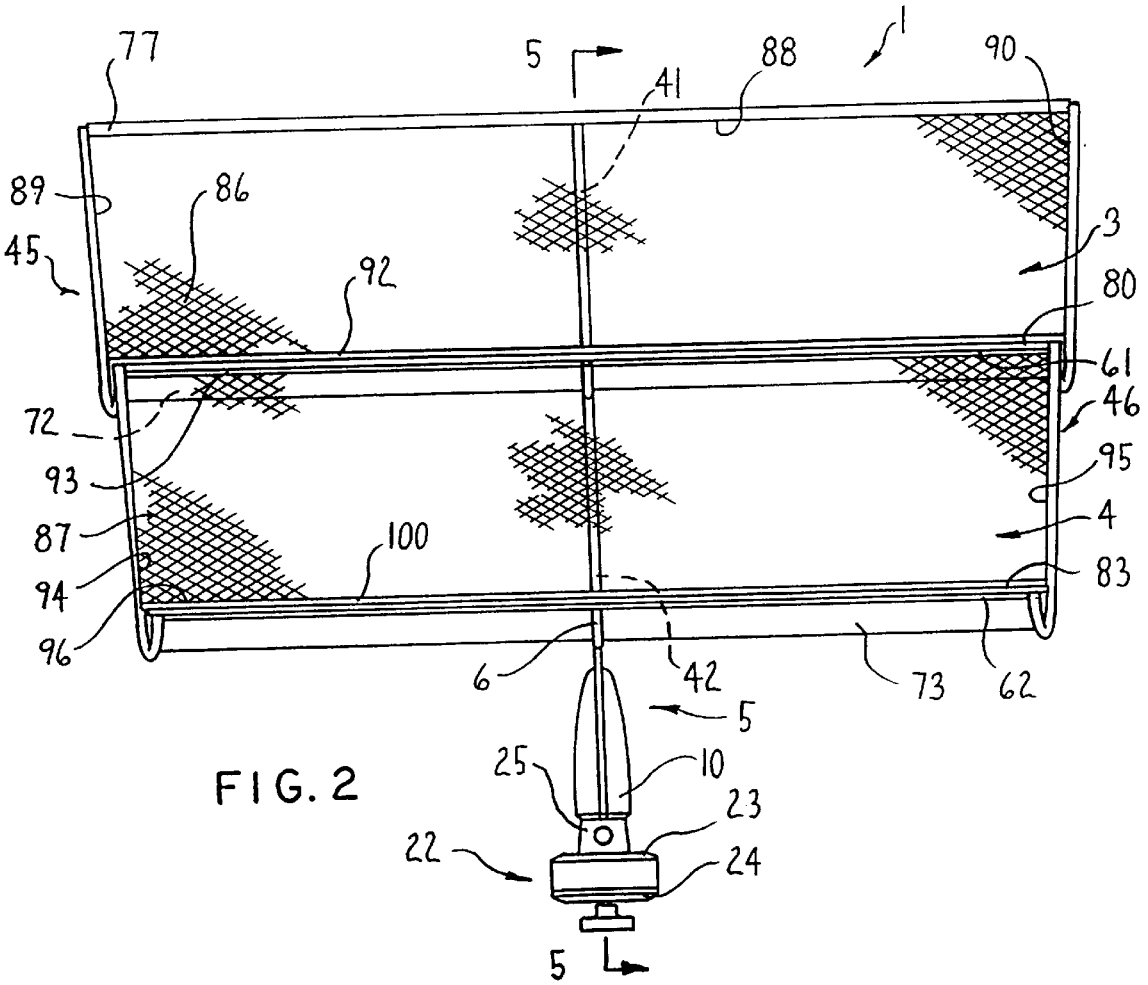
FIG. 2 is a front view thereof.
Figure 4:
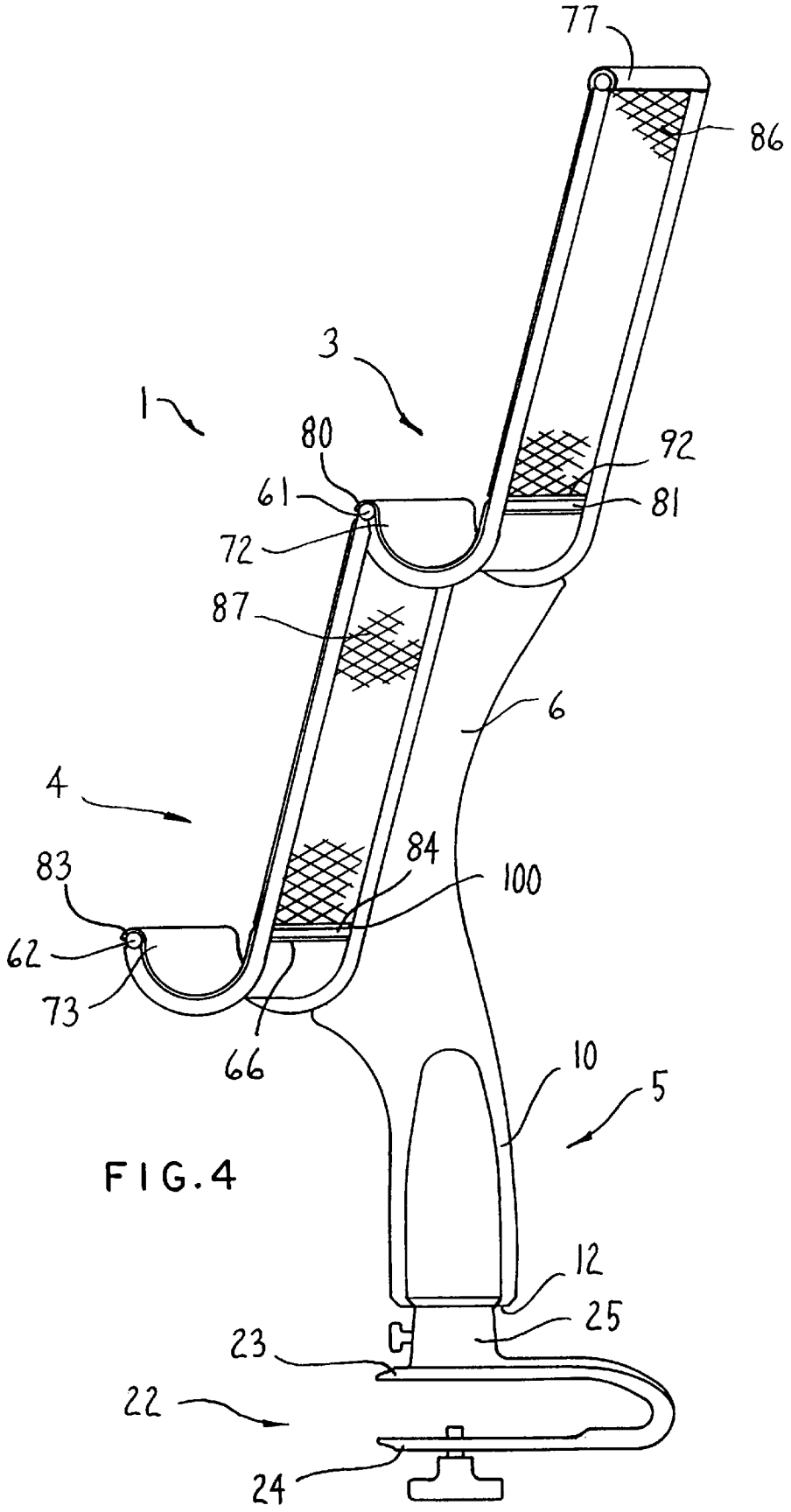
FIG. 4 is a side view thereof.

Certain terminology will be used in the following description for convenience in reference only and will not be limiting. For example, the words "upwardly", "downwardly", "rightwardly", and "leftwardly" will refer to directions in the drawings to which reference is made. The words "inwardly" and "outwardly" will refer to directions toward and away from, respectively, the geometric center of the unit and designated parts thereof. Said terminology will include the words specifically mentioned, derivatives thereof, and words of similar import.

DETAILED DESCRIPTION

Figure 7:
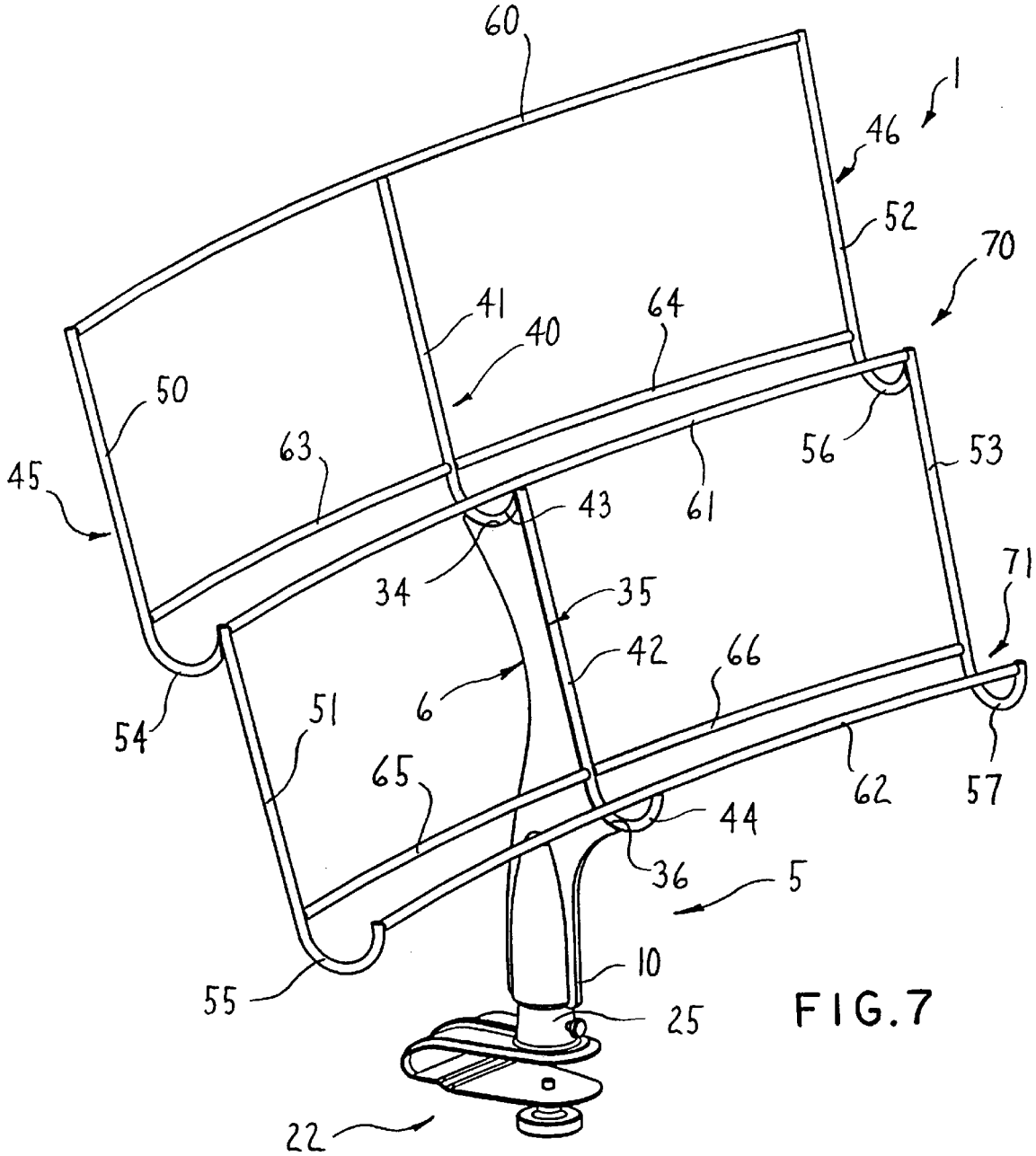
FIG. 7 is a perspective view of the frame thereof.

Referring to FIGS. 1 and 7, the invention includes a document storage and display unit 1 having a rigid open frame 2 which defines two shelves, more particularly an upper shelf 3 and a lower shelf 4, and a centrally located mounting arrangement 5. The shelves 3 and 4 are disposed generally vertically one above the other and are horizontally offset rearwardly from each other. The shelves 3 and 4 thereby define two independently accessible tiers upon which documents or other items can be stored in an upright position so as to face the user.

The open frame 2 preferably includes a centrally located, upright support arm 6 formed of a rigid plate-like material which has a base 10 which defines the lower end thereof and forms part of the mounting arrangement 5. A blind bore 11 (FIG. 5) is formed in the base 10 and extends upwardly in a tapering fashion from a lower surface 12 of base 10. The support arm 6 includes a mounting peg 14 fixedly attached thereto which has a generally bullet-shaped upper portion 15 and a cylindrical lower portion 20 of reduced diameter. The lower portion 20 preferably has an annular groove 21 disposed about the circumference thereof. The upper portion 15 preferably projects into the bore 11 and has a shape which substantially conforms thereto.

A C-shaped bracket 22 having upper and lower legs 23 and 24, and which also forms part of the mounting arrangement 5, is removably attached to the lower portion 20 of mounting peg 14 by means of an upwardly extending annular socket or tubular support hub 25 into which the cylindrical lower portion 20 of mounting peg 14 projects. A generally sidewardly extending threaded orifice 26 is disposed in an annular sidewall 30 of socket 25 and receives therein a set screw 31. Inward turning of the set screw 31 causes the forward end thereof to engage within the groove 21 and against the lower portion 20 of the mounting peg 14. An opposite turning of the set screw 31 causes same to move away from lower portion 20 to enable rotational or pivotal movement of the frame 2 with respect to the bracket 22.

The annular groove 21 preferably permits rotational movement of the frame 2 with respect to bracket 22 and also serves to maintain a connection therebetween when set screw 31 is loosened. A generally vertically disposed threaded orifice 32 extends through the lower leg 24 of bracket 22 and receives therein an additional set screw 33.

It should be understood that the mounting peg 14 need not be a separate component from the support arm 6, and that the support arm 6 may instead be configured so as to have an integral cylindrical lower portion of reduced diameter similar to portion 20.

Figure 5:
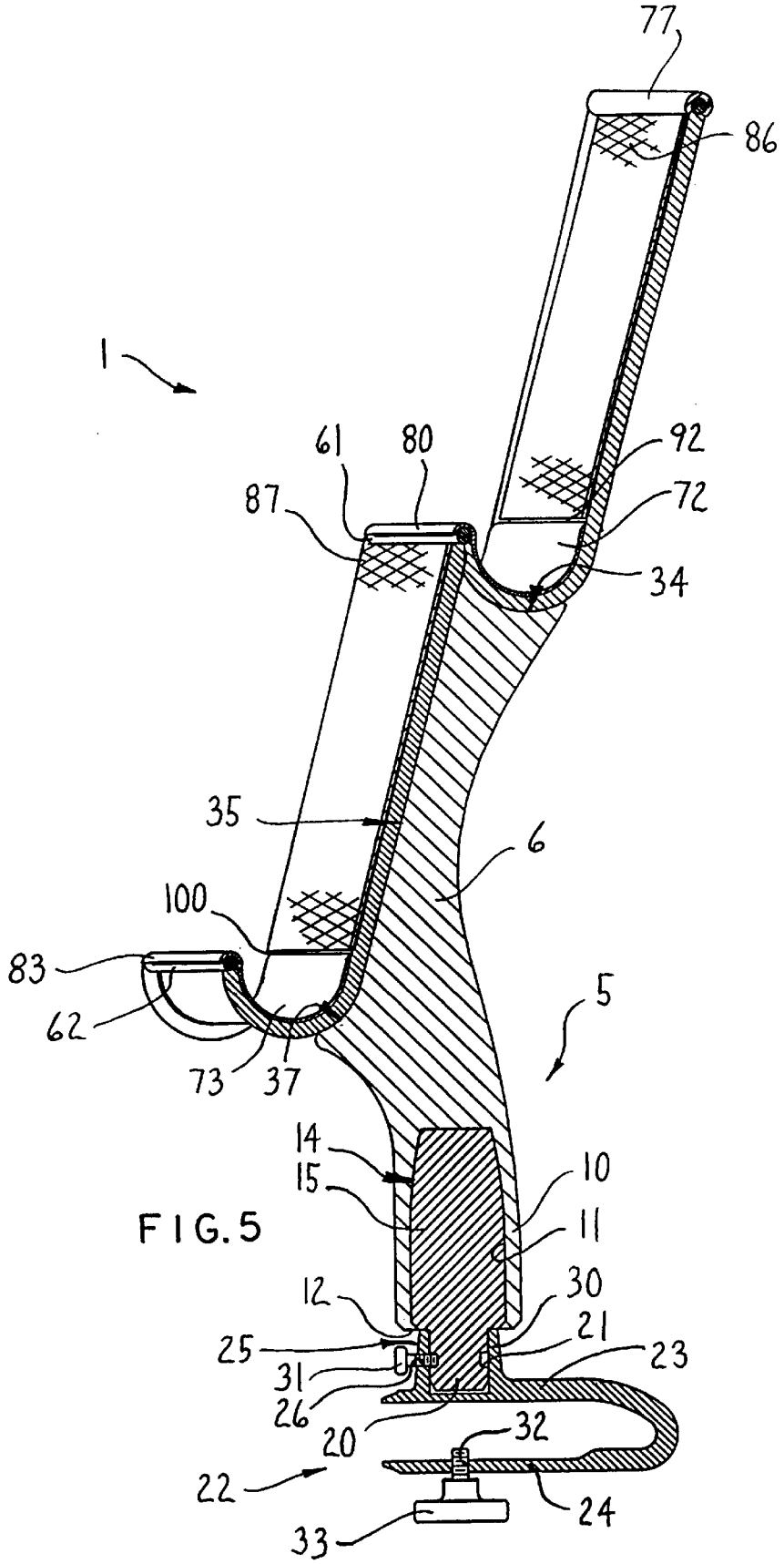
FIG. 5 is a cross-sectional view thereof taken substantially along line 5—5 of FIG. 2.

As best shown in FIGS. 5 and 7, the upper end of the support arm 6 is defined by an upwardly facing concave surface 34 and a forwardly facing inclined surface 35 which adjoins a generally forwardly facing concave lower surface 36.

The frame 2 further includes a central support rod 40 (FIG. 7) which is supported by and fixedly attached to (for example, by welding) surfaces 34, 35 and 36 of support arm 6. The central support rod 40 is embodied by substantially straight and parallel upper and lower parts 41 and 42 each having a generally forwardly projecting hook-shaped lower end 43 and 44, respectively. The hookshaped lower ends 43 and 44 are respectively attached to the upper and lower concave surfaces 34 and 36 of support arm 6, and the lower part 42 of central support rod 40 is attached to the inclined surface 35 of support arm 6.

The frame 2 also includes side support rods 45 and 46 located on either side of central support rod 40 and parallel thereto. The side support rods 45 and 46 have an essentially identical shape as the central support rod 40. More specifically, each side support rod 45 and 46 includes a pair of substantially straight and parallel upper and lower parts 50 and 51, and 52 and 53, and each upper and lower part includes a generally forwardly projecting hook-shaped lower end 54 and 55, and 56 and 57.

To rigidly fasten the central support rod 40 and the side support rods 45 and 46 to one another, the frame 2 includes a generally horizontally oriented upper support rod 60, intermediate support rod 61, and lower support rod 62. The upper support rod 60 is preferably fixedly attached, for example by welding, to the top ends of the central support rod 40 and the side support rods 45 and 46 and is generally perpendicular thereto. The intermediate support rod 61 is fixedly attached to the forwardmost terminal portions of the upper hook-shaped ends 43, 54 and 56 of the central support rod 40 and the side support rods 45 and 46, respectively. The lower support rod 62 is preferably fixedly attached to the forwardmost terminal portions of the lower hook-shaped ends 44, 55 and 57 of the central support rod 40 and the side support rods 45 and 46, respectively.

The frame 2 further includes generally horizontally and rearwardly oriented intermediate support rods 63 and 64 and horizontally and rearwardly oriented lower support rods 65 and 66. Intermediate rear support rod 63 preferably extends between side support rod 45 and central support rod 40, and intermediate rear support rod 64 extends between central support rod 40 and side support rod 46. The intermediate rear support rods 63 and 64 are preferably parallel to the frontwardly oriented intermediate support rod 61, are offset horizontally rearwardly therefrom, and along with support rod 61 and hook-shaped ends 43, 54 and 56 define an upper trough-like frame configuration 70.

Likewise, lower rear support rod 65 extends between side support rod 45 and central support rod 40, and lower rear support rod 66 extends between central support rod 40 and side support rod 46. The lower rear support rods 65 and 66 are parallel to the frontwardly oriented lower support rod 62, are offset horizontally rearwardly therefrom, and along with support rod 62 and hook-shaped ends 44, 55 and 57 define a lower trough-like frame configuration 71.

The upper, intermediate and lower support rods 60, 61 and 62, and the intermediate and lower support rods 63 and 64, and 65 and 66, are arcuate and therefore provide the frame 2 with a rounded, arcuate configuration.

The central support rod 40, side support rods 45 and 46, upper support rod 60, forwardly oriented intermediate and lower support rods 61 and 62, and rearwardly oriented intermediate and lower support rods 63 and 64 and 65 and 66 are preferably constructed of steel, and are generally cylindrical in shape with diameters of approximately ¼ inch. The support arm 6 and mounting peg 14 are also constructed of steel, and the bracket 22 is preferably constructed of aluminum.

Figure 6:
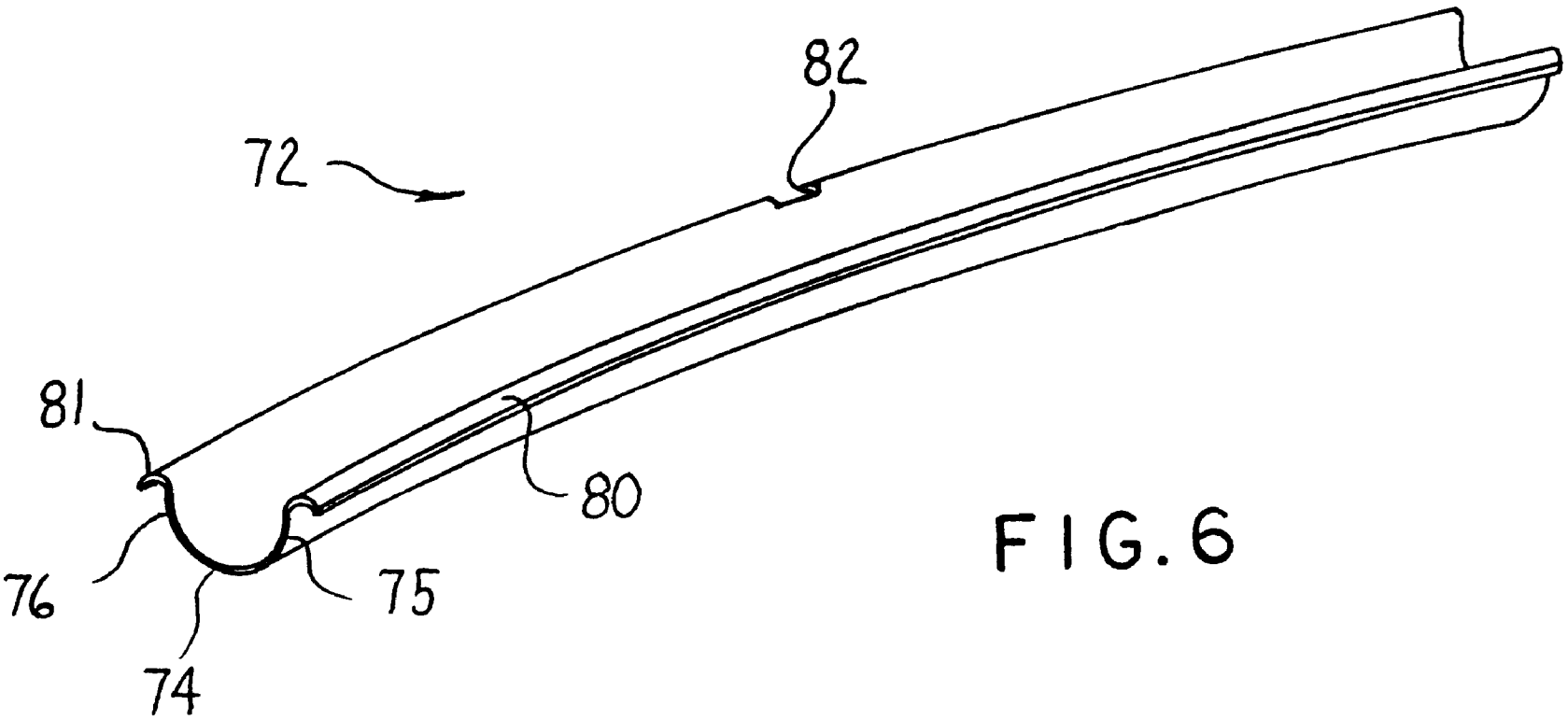
FIG. 6 is perspective view of a tray thereof.

The storage and display unit 1 further includes upper and lower trough-shaped (in cross-section) elongate trays 72 and 73 (FIGS. 1 and 6) which are respectively supported by the upper and lower trough-like frame configurations 70 and 71. As the trays 72 and 73 are identical to one another, only one such tray 72 is shown in FIG. 6. The tray 72 preferably has an elongate, arcuate shape to match the arcuate shape of the frame 2, and includes a rounded bottom wall 74 and two oppositely disposed front and rear side walls 75 and 76. Each of the front and rear side walls 75 and 76 terminate at a downwardly curving hook-shaped front lip 80 and rear lip 81, respectively. A centrally oriented, rearwardly opening slot 82 is disposed in rear lip 81.

In the assembled state of the document storage and display unit 1 (FIG. 1), the front lip 80 of the upper tray 72 engages over and curls around the forwardly oriented intermediate support rod 61, the rear lip 81 engages over and curls around each of the intermediate rear support rods 63 and 64, and the upper part 41 of the central support rod 40 projects into slot 82. Likewise, the front lip 83 of the lower tray 73 engages over and curls around the forwardly oriented lower support rod 62, the rear lip 84 engages over and curls around each of the lower rear support rods 65 and 66, and the lower part 42 of the central support rod 40 projects into the slot 78 (not shown) in the rear lip 84 of lower tray 73.

Each of the trays 72 and 73 are preferably constructed of a lightweight plastic, such as polypropylene or ABS resin (a copolymer of acrylonitrile, butadiene and styrene), and are snap-fitted into the trough-like frame portions 70 and 71 (FIG. 7).

The lower portions of the upper and lower shelves 3 and 4 are defined by the upper and lower trays 72 and 73, respectively, and the upper portions thereof are defined by upper and lower screen panels 86 and 87 of rigid, perforated metal (such as steel) which facilitate the flow of air and light therethrough. The screen panels 86 and 87 are fixedly attached by welding to portions of frame 2. More specifically, a top edge 88 of the upper screen panel 86 is preferably attached to the upper support rod 60 along the length thereof, and side edges 89 and 90 of upper screen panel 86 are respectively attached to upper parts 50 and 52 of the side support rods 45 and 46 along the length thereof. If desired, a rounded elongate plastic strip 77 may be provided along the length of the upper support rod 60 so as to cover same. A bottom edge 91 of upper screen panel 86 terminates a slight distance above the rear lip 81 of upper tray 72 so that a generally horizontally oriented gap 92 extends therebetween.

Similarly, a top edge 93 of lower screen panel 87 is attached to the intermediate support rod 61 along the length thereof under the front lip 80 of upper tray 72, and side edges 94 and 95 of lower screen panel 87 are respectively attached to lower parts 51 and 53 of the side support rods 45 and 46 along the length thereof. A bottom edge 96 of lower screen panel 87 terminates a slight distance above the rear lip 84 of lower tray 73 so as to form a generally horizontally extending gap 100 therebetween.

Further, each of the upper and lower screen panels 86 and 87 may, if desired, be fixedly fastened by welding at intermediate areas thereof to the upper and lower parts 41 and 42 of the central support rod 40.

Alternatively, the top edge 93 of lower screen panel 87 may terminate a slight distance below the front lip 80 of upper tray 72 such that a horizontally extending gap (not shown) similar to gaps 92 and 100 is formed therebetween.

The arcuate frame 2 enables easier viewing of documents or other items located on shelves 3 and 4. In addition, the forwardly facing inclined surface 35 of the central support arm 6 and the resulting inclined frame configuration also contribute to easier viewing of the items located on shelves 3 and 4 by the user. Further, since the shelves 3 and 4 are horizontally offset relative to each other or, in other words, are vertically staggered, documents or other items can be stored one above the other in any one or both of the shelves 3 and 4. Even with items stored on shelves 3 and 4, the screen panels 86 and 87 still permit the passage of air and light therethrough and further permit a user to be able to look through the screen panels 86 and 87.

In accordance with the preferred embodiment of the invention, the document storage and display unit 1 is approximately 22 inches in height and approximately 28 inches in length.

Figure 8:
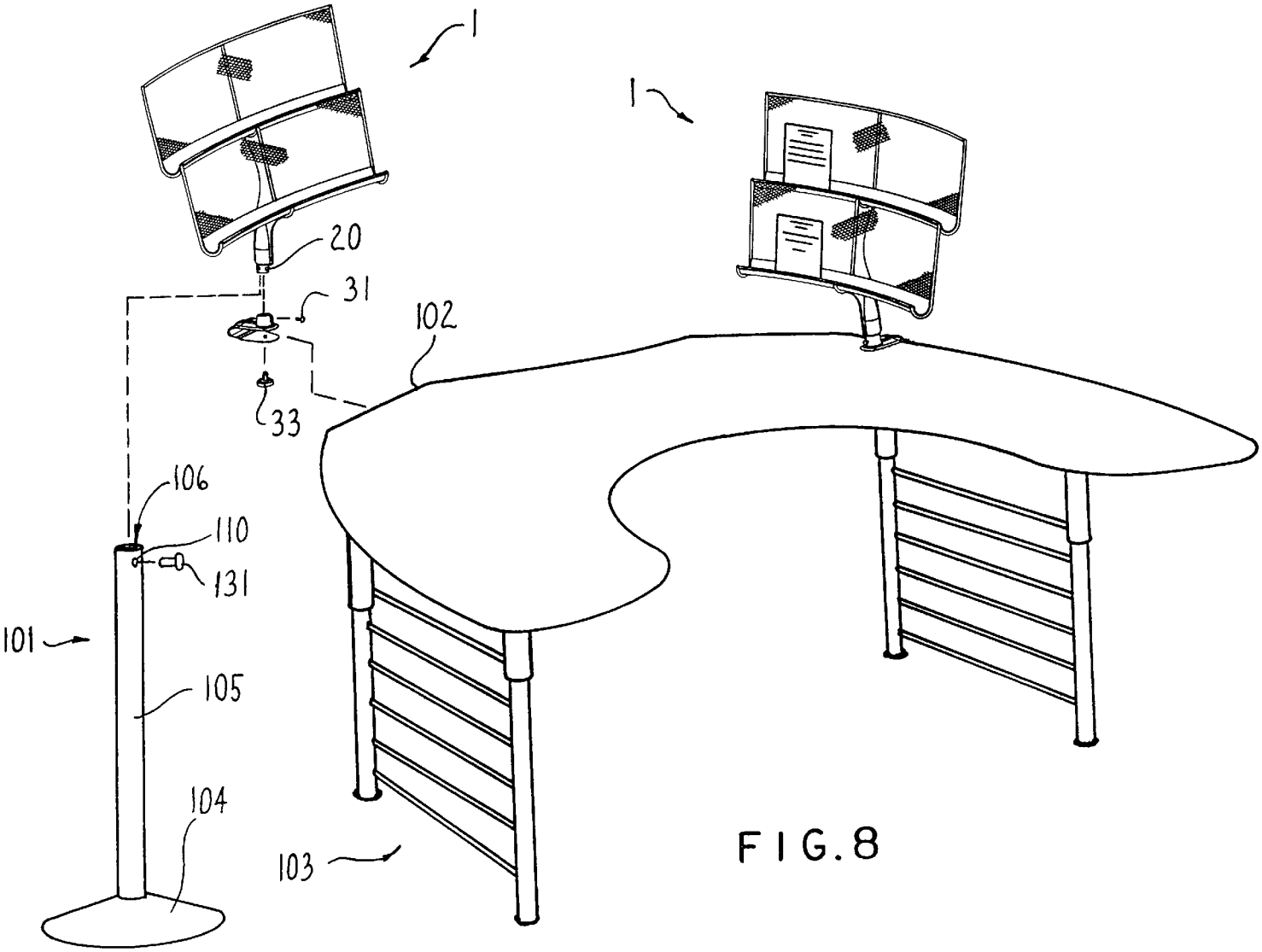
FIG. 8 is an exploded view of the document storage and display unit and mounting arrangement illustrating the mounting of the unit on a table or alternatively on a upright stand.

With reference to FIG. 8, the document storage and display unit 1 is adapted for mounting atop an upright stand 101 or along an edge 102 of a work surface such as a table 103 as follows.

The upright stand 101 preferably includes a base 104 and a rigid tube 105 which extends upwardly from base 104 and has an open top end or tubular support hub 106. A sidewardly extending threaded hole 110 opens into the interior of the tube 105 and is disposed adjacent the top end 106 thereof.

In use, the document storage and display unit 1 may be used with stand 101 by loosening the set screw 31 and removing the bracket 22 from the mounting peg 14. The cylindrical lower portion 20 of mounting peg 14 is then inserted into the open top end 106 of stand 101 and lowered until the lower surface 12 of base 10 (FIG. 5) rests atop the top end 106 of tube 105. The document storage and display unit 1 is fixed to stand 101 by threading a set screw 131 into the threaded hole 110 of the stand 101 until the forward end of screw 131 engages in groove 21 and against lower portion 20 of mounting peg 14. The position of the document storage and display unit 1 may be adjusted with respect to the stand 101 by loosening the set screw 131, rotating the unit 1 to the desired position and then re-tightening the set screw 131. The document storage and display unit 1 is thus usable as a freestanding unit which can be placed in virtually any desired work area and, as mentioned above, may be pivoted with respect to stand 101.

As also shown in FIG. 8, the document storage and display unit 1 may also be utilized with a table 103 or other work surface by loosening set screw 33 and sliding the upper and lower legs 23 and 24 of bracket 22 over the edge 102 of table 103 so that the edge 102 is sandwiched therebetween. The set screw 33 is then tightened to secure the unit 1 to the table 103. As shown in FIG. 8, multiple document storage and display units 1 in accordance with the invention may be utilized with table 103. The storage and display unit 1 may be pivoted with respect to table 103 by loosening set screw 31, turning the unit 1 to the desired position, and tightening set screw 31 against the lower portion 20.

It should be understood that although the preferred embodiment includes two shelves 3 and 4, it is within the scope of the invention to provide a greater or lesser number of shelves.

In accordance with an alternative embodiment of the invention not shown here, a flexible fabric or cloth screen material may be substituted for screen panels 86 and 87, which material is fastenable to frame 2 by means of velcro, adhesive, snaps or other appropriate fasteners.

Although particular, preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An article storage and display unit comprising:

a frame;

upper and lower horizontally elongate shelves disposed on said frame in a vertical manner one above the other, said upper shelf being horizontally offset rearwardly relative to said lower shelf;

each said shelf being defined by an upwardly facing bottom wall and a rear wall extending upwardly from said bottom wall, said bottom wall of said upper shelf adjoining an upper edge of said rear wall of said lower shelf; and said frame including a mounting arrangement adapted for removably and selectively mounting said article storage and display unit on both a work surface and an upright stand.

2. The article storage and display unit of claim 1 wherein said frame includes a support arm disposed generally centrally with respect to said shelves, and said mounting arrangement includes a mounting peg disposed at a lower end of said support arm and a C-shaped bracket removably attached to said mounting peg.

3. The article storage and display unit of claim 2 wherein said mounting peg is configured for insertion into a top opening hole of an upright stand such that said article storage and display unit is usable as a freestanding unit.

4. The article storage and display unit of claim 3 wherein said bracket is configured for gripping an edge of a work surface such as a table.

5. The article storage and display unit of claim 1 wherein said mounting arrangement includes means for permitting rotation of said unit with respect to the work surface and the stand.

6. The article storage and display unit of claim 1 including an upper screen-like panel and a lower screen-like panel overlying and attached to said frame and respectively defining said rear walls of said upper and lower shelves.

7. The article storage and display unit of claim 6 wherein said upper and lower screen-like panels are constructed of perforated metal having openings therein for permitting the passage of air and light therethrough.

8. The article storage and display unit of claim 6 including upper and lower trays disposed on said frame and respectively defining said bottom walls of said upper and lower shelves, each said tray having an upwardly opening trough-like configuration.

9. The article storage and display unit of claim 1 wherein said frame has an arcuate shape so as to define a curved shape of said article storage and display unit.

10. The article storage and display unit of claim 1 wherein said frame includes a plurality of generally vertically extending and spaced-apart support members and a plurality of generally horizontally extending and spaced-apart support members extending sidewardly between said vertical support members, said frame being open in areas between said vertical support members and said horizontal support members.

11. The article storage and display unit of claim 10 including an upper screen-like panel extending horizontally and vertically across some of said open areas to define said rear wall of said upper shelf, and a lower screen-like panel extending horizontally and vertically across additional ones of said open areas to define said rear wall of said lower shelf.

12. The article storage and display unit of claim 10 wherein said plurality of horizontal support members includes a first pair of support members parallel to one another and horizontally offset relative to one another and a second pair of support members parallel to one another and horizontally offset relative to one another, said first pair of support members being disposed above and horizontally rearwardly offset from said second pair of support members, and an upper tray defining said bottom wall of said upper shelf is disposed along and supported by said first pair of support members and a lower tray defining said bottom wall of said lower shelf is disposed along and supported by said lower pair of support members.

13. The article storage and display unit of claim 12 wherein said upper and lower trays each have an upwardly opening trough-like shape, a frontwardly facing lip and a rearwardly facing lip, said front lip of said upper tray engaging a forwardly oriented one of said first pair of support members and said rear lip of said upper tray engaging a rearwardly oriented one of said first pair of support members, said front lip of said lower tray engaging a forwardly oriented one of said second pair of support members and said rear lip of said lower tray engaging a rearwardly oriented one of said second pair of support members.

14. The article storage and display unit of claim 1 wherein said rear walls of said upper and lower shelves are angled upwardly such that articles such as documents are storable in an upwardly inclined position relative to the user.

15. An article storage and display unit comprising:

a frame;

upper and lower horizontally elongate shelves disposed on said frame in a vertical manner one above the other, said upper shelf being horizontally offset rearwardly relative to said lower shelf;

a bottom portion of each said upper and lower shelf being respectively defined by upper and lower trays each having an upwardly opening trough-like configuration and being supported by said frame;

a rear portion of each said upper and lower shelf being respectively defined by upper and lower perforated screen-like panels overlying and attached to said frame; and a mounting arrangement including a generally centrally disposed and downwardly cantilevered support arm forming part of said frame and having a lower generally cylindrical end portion, and a tubular support hub telescopingly engaged over said cylindrical end portion such that said frame is rotatable with respect to said support hub.

16. The article storage and display unit of claim 15 wherein said mounting arrangement includes a generally C-shaped mounting bracket for gripping an edge of a work surface, said tubular support hub extending upwardly from said mounting bracket and having a threaded hole extending generally sidewardly therethrough, and further including a threaded set screw disposed in said threaded hole such that a forwardmost end thereof is engageable against said cylindrical end portion to lock said frame into a desired rotational position with respect to said mounting bracket and the work surface.

17. The article storage and display unit of claim 16 wherein said lower cylindrical portion includes an annular groove therein configured for receiving said forwardmost end of said set screw.

18. The article storage and display unit of claim 15 wherein said tubular support hub forms an upper end of an upright stand, said upper end of said stand including a threaded orifice extending generally sidewardly therethrough and a threaded set screw disposed in said threaded orifice such that a forwardmost end thereof is engageable against said cylindrical end portion to lock said frame into a desired rotational position with respect to said stand.

19. The article storage and display unit of claim 18 wherein said lower cylindrical portion includes an annular groove therein configured for receiving said forwardmost end of said set screw.

* * * * *